US007665645B2

(12) United States Patent
Smith et al.

(10) Patent No.: US 7,665,645 B2
(45) Date of Patent: Feb. 23, 2010

(54) STAPLER

(75) Inventors: Robert Stevenson Smith, Bend, OR (US); Yu Shi Cheng, Gaungdong (CN); Anthony Jairam, Sunrise, FL (US)

(73) Assignee: TSI Manufacturing LLC, Bend, OR (US)

( * ) Notice: Subject to any disclaimer, the term of this patent is extended or adjusted under 35 U.S.C. 154(b) by 0 days.

(21) Appl. No.: 11/977,401

(22) Filed: Oct. 23, 2007

(65) Prior Publication Data

US 2008/0054044 A1 Mar. 6, 2008

Related U.S. Application Data

(62) Division of application No. 11/410,862, filed on Apr. 24, 2006, now Pat. No. 7,311,236.

(60) Provisional application No. 60/674,441, filed on Apr. 25, 2005.

(51) Int. Cl.
*B27F 7/36* (2006.01)
*B27F 7/19* (2006.01)
*B25C 7/00* (2006.01)

(52) U.S. Cl. ..... 227/155; 227/19; 227/154; 227/156

(58) Field of Classification Search ..... 227/155; 29/525.05
See application file for complete search history.

(56) References Cited

U.S. PATENT DOCUMENTS

| | | | | |
|---|---|---|---|---|
| 389,661 | A | 9/1888 | Mandel et al. | |
| 2,320,703 | A | 6/1943 | Maynard | |
| 3,282,489 | A | 11/1966 | March | |
| 3,346,163 | A | 10/1967 | Manganaro | |
| 4,199,095 | A * | 4/1980 | Yamanoi | 227/125 |
| 4,491,260 | A | 1/1985 | Jimena | |
| 4,593,847 | A * | 6/1986 | Hagemann | 227/155 |
| 4,844,319 | A | 7/1989 | Kurosawa | |
| 4,940,177 | A | 7/1990 | Jimena | |
| 5,004,142 | A * | 4/1991 | Olesen | 227/155 |
| 5,029,745 | A | 7/1991 | Akizawa et al. | |
| 5,413,266 | A | 5/1995 | Jaoram | |
| 5,975,396 | A | 11/1999 | Manabe | |
| 6,036,074 | A * | 3/2000 | Manabe | 227/155 |
| 6,056,183 | A | 5/2000 | Tanabe | |
| 6,164,513 | A * | 12/2000 | Yoshie | 227/155 |
| 6,250,531 | B1 * | 6/2001 | Yagi | 227/79 |
| 6,371,352 | B1 | 4/2002 | Mochizuki | |
| 6,484,921 | B2 | 11/2002 | Hakoxzaki et al. | |
| 6,776,321 | B2 | 8/2004 | Jairam et al. | |
| 6,820,790 | B2 | 11/2004 | Ura | |

(Continued)

FOREIGN PATENT DOCUMENTS

| | | |
|---|---|---|
| WO | WO 2004/011202 A1 | 2/2004 |

(Continued)

*Primary Examiner*—Rinaldi I. Rada
*Assistant Examiner*—Lindsay Low
(74) *Attorney, Agent, or Firm*—Chernoff, Vilhauer, McClung and Stenzel, LLP

(57) ABSTRACT

An anvil for a stapler comprises plural anvil plates supported by the frame of the stapler. At least one of the anvil plates includes a first surface comprising a portion of the anvil surface and a second surface including a relieved portion in which the stapler's clincher is slidable.

4 Claims, 8 Drawing Sheets

U.S. PATENT DOCUMENTS

| | | | | |
|---|---|---|---|---|
| 6,981,627 | B2 | 1/2006 | Tsai | |
| 7,097,087 | B2 | 8/2006 | Lammers et al. | |
| 7,111,378 | B2 | 9/2006 | Aldana | |
| 7,124,925 | B2 * | 10/2006 | Ishizaki | 227/155 |
| 7,228,999 | B2 | 6/2007 | Oide et al. | |
| 7,334,716 | B2 * | 2/2008 | Tsai | 227/155 |
| 2005/0006745 | A1 | 3/2005 | Lammers et al. | |
| 2005/0077338 | A1 * | 4/2005 | Ishizaki | 227/155 |
| 2005/0269380 | A1 | 12/2005 | Shimizu et al. | |
| 2006/0273134 | A1 | 12/2006 | Smith et al. | |

FOREIGN PATENT DOCUMENTS

| | | | |
|---|---|---|---|
| WO | WO 2004/082896 | A1 | 9/2004 |

* cited by examiner

STAPLER

CROSS-REFERENCE TO RELATED APPLICATIONS

This application is a division of application Ser. No. 11/410,862, filed Apr. 24, 2006, now U.S. Pat. No. 7,311,236 B2, which claims the benefit of U.S. Provisional Application No. 60/674,441, filed Apr. 25, 2005.

BACKGROUND OF THE INVENTION

The present invention relates to a stapler and, more particularly, a stapler that is resistant to jamming.

An electric stapler that automatically drives and clinches a staple is particularly useful when frequent stapling is required or when stapling thicker, penetration resistant workpieces comprising many layers of material or layers of heavier material. Both battery and AC powered electric staplers are commercially available. Battery power offers cordless portability, while AC power reduces the weight of the stapler and avoids the need to periodically replace or recharge the battery.

In a typical electric stapler, a workpiece, typically comprising a plurality of layers of paper, leather, fabric or similar material, is compressed between an anvil and a portion of a movable magazine in which a staple assembly comprising a plurality of staples detachably bonded together is retained. The staples are typically fabricated from wire that is bent to form a crown with a leg projecting normal to the crown at each end. An electric motor urges a driver, slidable inside the magazine, toward the front surface of the workpiece. A surface of the driver engages the crown of the first staple in the staple assembly, separating the staple from the staple assembly and forcing the staple out of the magazine causing the ends of the legs to penetrate the front surface of the workpiece. The legs of the staple are preferably longer than the thickness of the workpiece so that portions of the legs that project from the back surface of the workpiece can be clinched, bent back toward the workpiece, to bind the layers of the workpiece together and secure the staple in the workpiece.

Staples are commonly clinched by forcing the ends of the legs against a surface of a fixed anvil until the columnar legs buckle. The buckling may be facilitated by curved surfaces in the anvil that are arranged to receive and deflect the ends of the legs as they are pushed through the back surface of the workpiece. Continued movement of the driver, to force the crown of the staple into contact with the front surface of the workpiece, bends the legs back into contact with the back surface of the workpiece completing the clinching. However, clinching a staple by forcing the ends of the legs against the surface of a fixed anvil often proves problematic when stapling thicker workpieces or workpieces comprising layers of heavier or penetration resistant material. Thicker, penetration resistant workpieces commonly require a heavy-duty staple with stronger legs that will not bend when forced to pierce the workpiece. Clinching a heavy-duty staple by forcing the ends of the legs against the surface of a fixed anvil is problematic because the stronger legs are more resistant to bucking and a relatively short portion of the leg may protrude from the back surface of a thicker workpiece. The higher force that must be exerted by the driver to clinch a stronger staple often leads to inadequate clinching or lateral displacement of the staple causing a portion of the staple to lodge between the moving parts of the stapler jamming the mechanism.

Staplers using heavy-duty staples or used to staple heavier, thicker workpieces often include a movable clincher that operates in conjunction with the driver to bend the legs of the staple. Ura, U.S. Pat. No. 6,820,790 B2 discloses two movable clinching mechanisms suitable for use with an electric stapler. The clinching mechanisms comprise a plurality of spaced apart, parallel, stationary anvil plates arranged to support a workpiece on their upper edges. A clincher, comprising a clinching arm movable between a retracted position and a clinching position where a surface of the arm is substantially even with the workpiece supporting edges of the plates, is rotatably supported between each pair of stationary anvil plates. A recess, formed between the parallel plates when the clincher arm is retracted, is arranged to receive the legs of a staple as the legs erupt from the back surface of the workpiece. When the driver has pushed the staple into the workpiece, a clincher drive mechanism rotates the clinchers causing the arms of the clinchers to sweep through their respective recesses and engage and bend the protruding legs of the staple. While movable clinching mechanisms promote more consistent clinching of heavier staples, the clinching mechanisms comprise several small, flexible parts that are separated by clearances and portions of the staple can lodge in the clearances preventing further operation of the stapler. Moreover, the parts of the clincher mechanisms are small and wear rapidly, exacerbating jamming and necessitating frequent replacement of the mechanism.

Staples can also become lodged in the clearance between the movable driver and the inner surface of the nosepiece which guides the staple and the driver as the staple is pushed out of the magazine and into the workpiece. The driver moves normal to the longitudinal axis of a staple assembly which is retained in the magazine and urged toward the inner surface of the nosepiece at the front of the magazine. As the driver moves toward the anvil, guided by the inner surface of the nosepiece, a surface of the driver contacts the crown of the first staple in the staple assembly, separating the staple from the assembly and forcing the ends of the legs to pierce the front surface of the workpiece. The higher forces required to pierce penetration resistant workpieces and clinch heavy-duty staples increase the likelihood that the crown of the staple will be displaced laterally on the contact surface of the driver and become lodged between the driver and the inner surface of the nosepiece preventing further operation of the stapler, a problem that is exacerbated by wear of the inner surface of the nosepiece.

What is desired, therefore, is a stapler including a staple clincher that resists jamming.

DETAILED DESCRIPTION OF PREFERRED EMBODIMENTS

Figure 1:
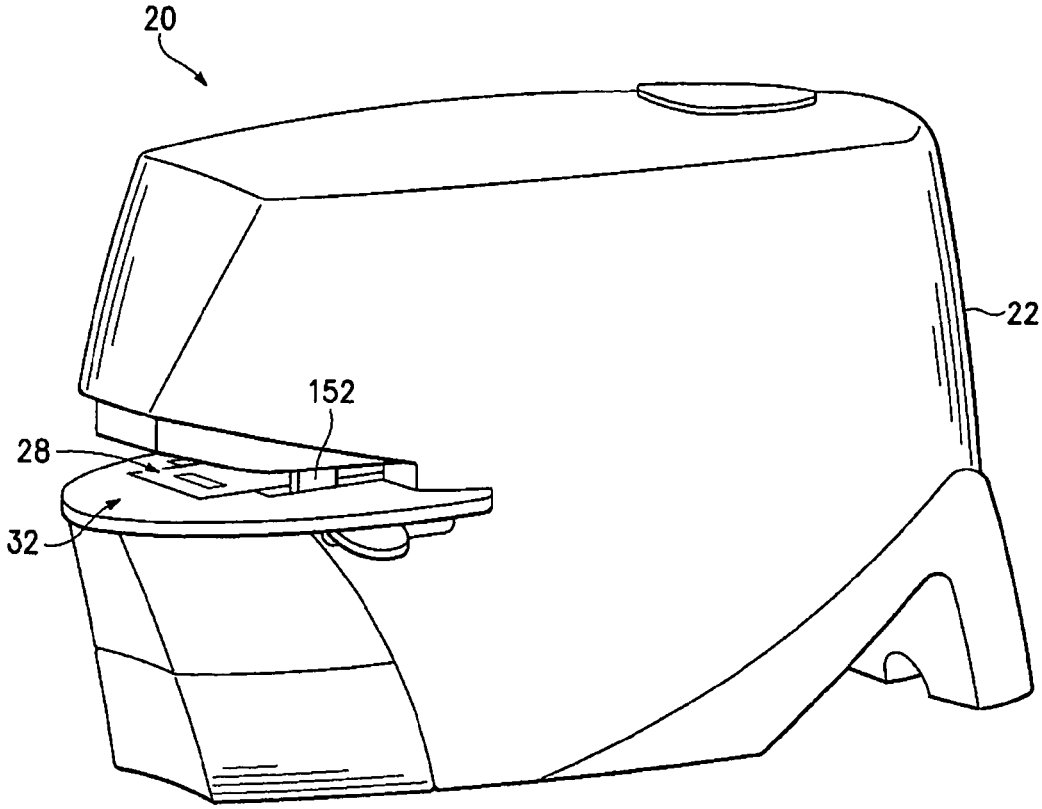
FIG. 1 is a perspective view of an electric stapler.
Figure 2:
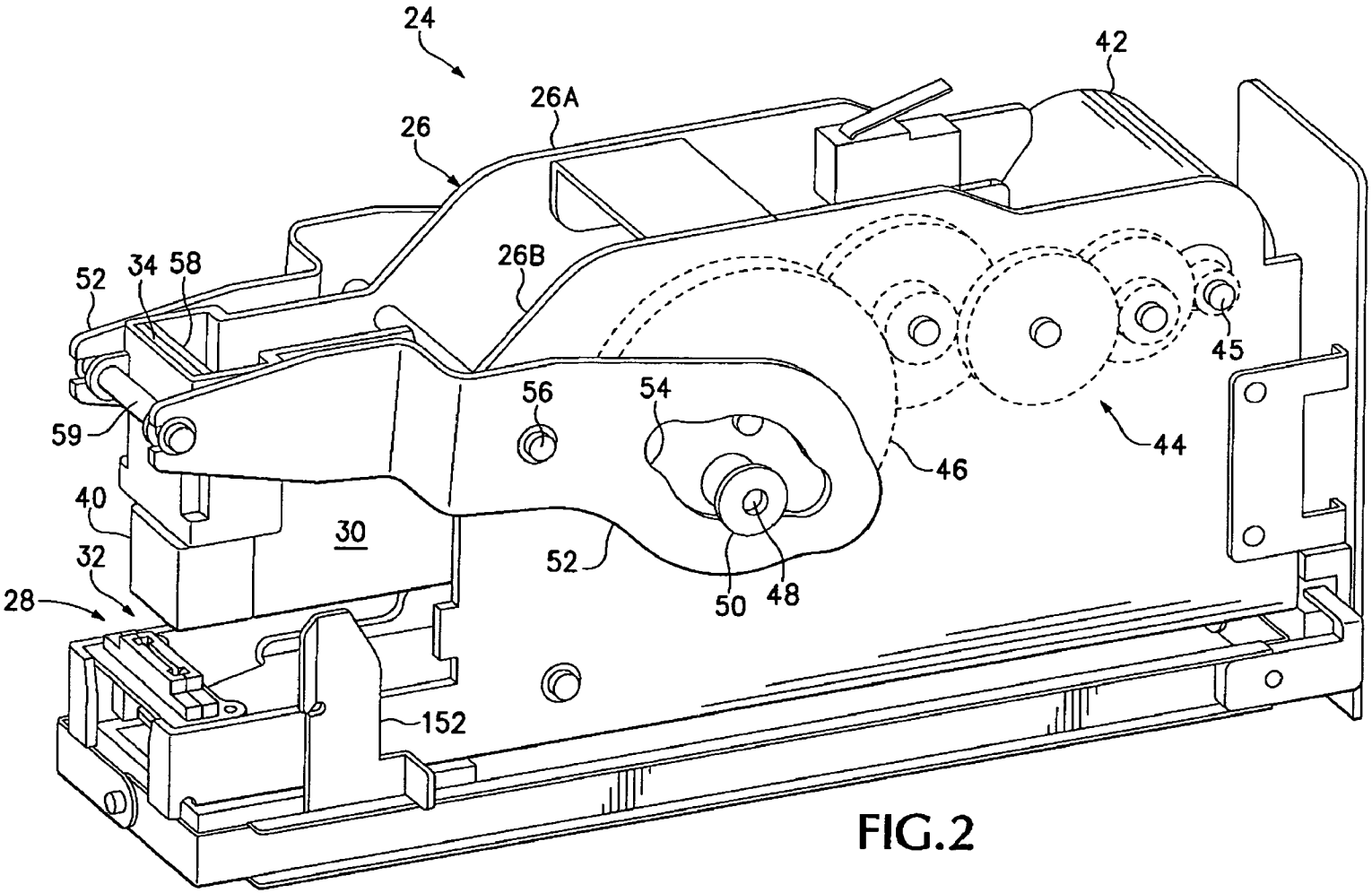
FIG. 2 is a perspective view of the stapling mechanism of the electric stapler of FIG. 1.
Figure 3:
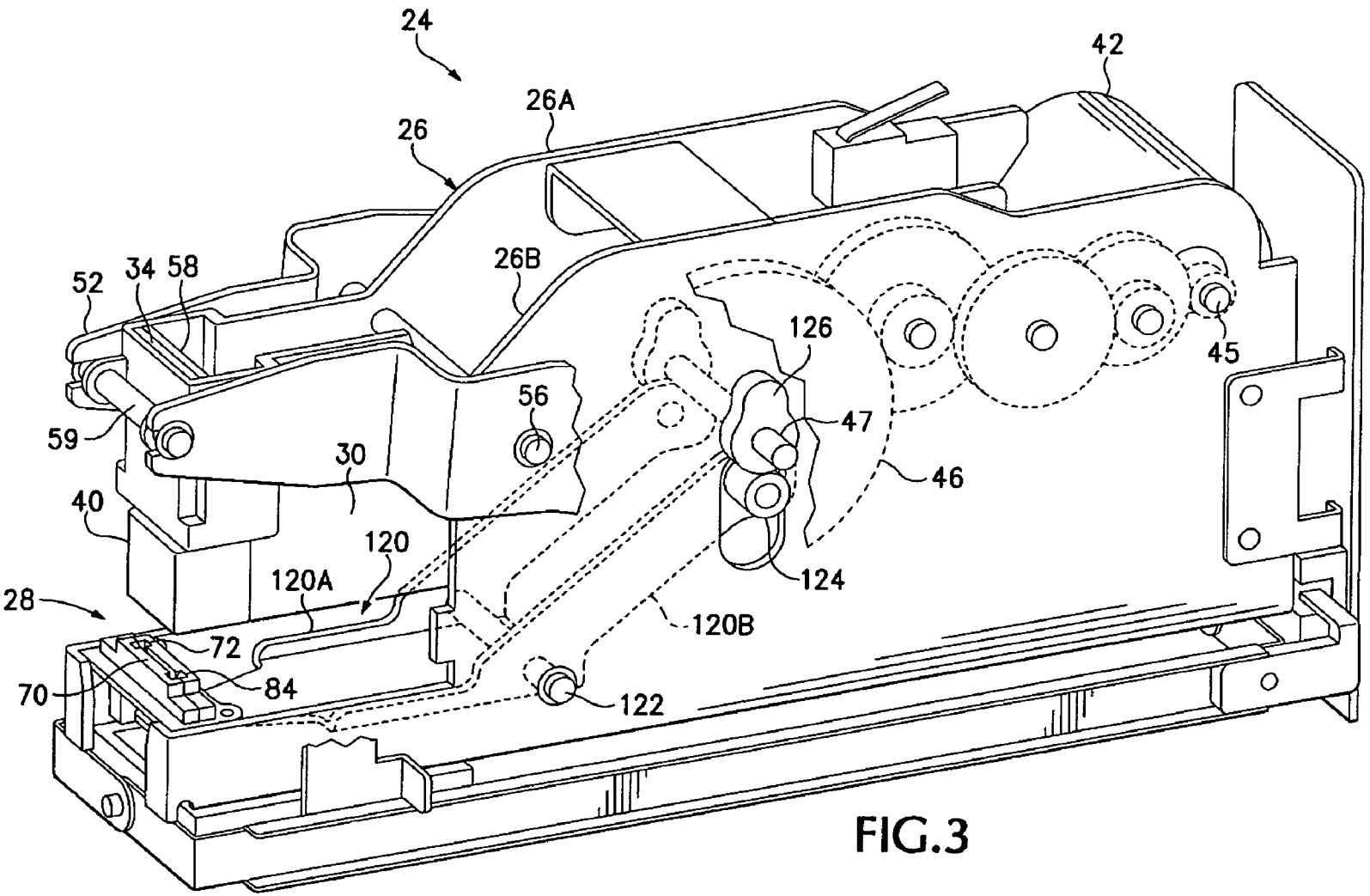
FIG. 3 is a perspective view of the stapling mechanism of FIG. 2 illustrating the clincher drive mechanism.

Referring in detail to the drawings where similar parts are identified by like reference numerals, and, more particularly to FIGS. 1, 2 and 3, the stapler 20 comprises generally a stapling mechanism 24 that is retained within a housing 22 that is decorative and provides an interface to support the stapling mechanism on the surface on which the stapler will be used. The stapling mechanism is supported by a frame 26 comprising, generally, a plate bent to form a channel with a pair of spaced apart, parallel sides 26A, 26B that are connected to each other along their lower edges. An anvil assembly 28 that supports the workpiece during stapling is supported by the frame.

Staples are stored in a magazine assembly 30 that is pivotally supported between the parallel sides of the frame by a pin. A return spring supports the weight of the magazine assembly creating a gap or throat 32 between the lower surface of the magazine assembly and the anvil in which a portion of a workpiece to be stapled can be inserted. The workpiece typically comprises a plurality of layers of paper, cloth or similar material. The magazine assembly includes a magazine frame comprising, generally, a plate bent to form a channel with spaced apart, parallel, vertical sides that are connected along their lower edges by a base. The forward portions of the vertical sides, distal of the pivot pin, are bent toward the central longitudinal axis of the magazine frame to substantially enclose the end of the magazine frame. A top guide 58 comprising a channel with parallel, spaced apart sides that are connected along their lower edge by a base and having a closed forward end is affixed between the parallel sides of the magazine frame. The inner surface of the closed forward end of the magazine frame and the parallel outer surface of the closed forward end of the top guide form a guide for a slidably movable driver 34.

Figure 5:
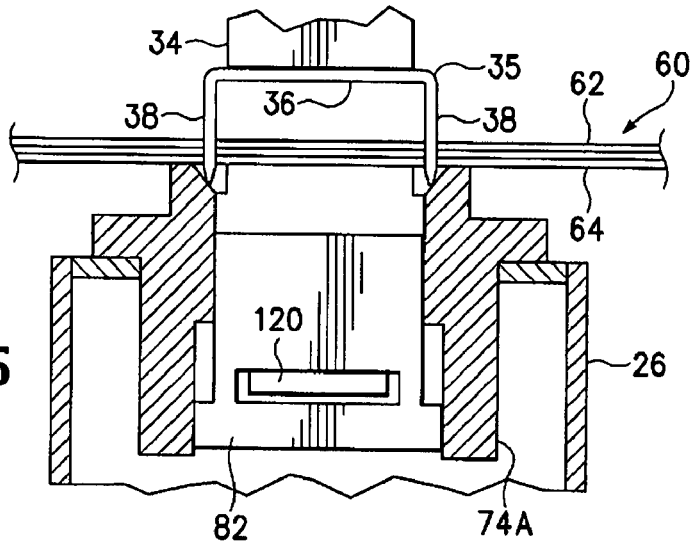
FIG. 5 is a section view along line 5-5 of FIG. 4 showing the clincher in the retracted position.

Referring to FIG. 5, the staples 35 comprise a wire bent to form a crown 36 with a leg 38 projecting normal to the crown at each end. For convenience in handling by the stapler's user, a plurality of staples are arranged adjacent to each other and detachably bonded together, by an adhesive or otherwise, to form an elongate, channel-shaped staple assembly. The staple assembly is retained in a magazine channel assembly that is, in turn, slidably arranged in the lower portion of the magazine frame. The magazine channel assembly comprises a magazine channel having a base and sides projecting normally from the base and a nosepiece 40 that connects the sides of the magazine channel to close the forward end of the channel. The base of the magazine channel does not extend to the inner surface of the nosepiece creating an aperture through which a staple, in contact with the inner surface of the nosepiece and detached from the staple assembly, can pass. The staple assembly is urged toward the inner surface of the nosepiece by a pusher spring that is connected to a pusher that is slidably arranged in the magazine channel and bears on the surface of the staple assembly that is distal of the nosepiece.

To load staples into the magazine, the user releases a latch that engages the magazine channel. When the latch is released, the pusher spring urges the magazine channel to extend, exposing the throat of the channel to the user. By sliding and holding the pusher toward the rear of the magazine channel, the user can access the throat of the channel and insert a staple assembly with the crown of the staples uppermost and the ends of the legs pointed toward the base of the channel. A spring plate, attached to the lower surface of the magazine frame, includes a projecting portion that protrudes through an aperture in the base of the magazine and elastically bears on the lower surface of the base of the magazine channel. Friction between the magazine channel and the projecting portion of the spring plate resists the sliding movement of the channel assembly to prevent unanticipated extension of the channel assembly when the channel assembly is unlatched An electric motor 42, attached to the frame, provides the power to operate the stapling mechanism. The frame also supports a gear train 44 comprising a series of paired pinions and driven gears that transfer motion, at reduced speed and increased torque, from the shaft 45 of the electric motor to a pair of driven output gears 46 rotationally supported, respectively, on either side of the frame by a shaft 47. The outer surface of each output gear includes a bore, offset from the center of rotation of the gear, to accept a pin 48 that serves as an axle for a cam follower 50. Each cam follower is respectively arranged to engage portions of a driver arm 52 comprising the surface bounding a cam aperture 54 in the driver arm. A pin 56 that engages the driver arms and the frame pivotally supports a driver arm on either side of the frame.

When the motor shaft is rotated during a stapling cycle, the output gears are rotated by the interaction of the teeth of the pinions and driven gears of the gear train. The forward ends of the driver arms 52, distal of the cam apertures, are pivoted downward on the driver arm pivot pin 56 as a result of the interaction of the cam followers and the bounding surfaces of the cam apertures in the driver arms. As the forward ends of the driver arms pivot downward, the force of the return spring balancing the magazine is overcome causing the front portion of the magazine to pivot downward into contact with the front surface 62 of a workpiece 60 having a back surface 64 that is supported on the anvil. The resistance of the workpiece to compression stops the pivoting of the magazine, but the driver arms continue to pivot as a result of interaction of the cam followers and the bounding surfaces of the cam apertures moving the driver 34, which is pivotally connected to the forward ends of the driver arms by a pin 59, toward the workpiece. The driver is slidable between the inner front surface of the magazine and the parallel outer front surface of the top guide that is nested in and affixed to the magazine. The spring loaded pusher urges the staple assembly into contact with the inner surface of the nosepiece which is hardened to resist wear from contact with the moving staple and driver. Referring to FIG. 5, as the driver moves toward the workpiece, a contact surface of the driver impinges upon the crown of the first staple in the assembly. The bond between the first staple and its neighboring staple in the staple assembly is broken and the first staple is separated from the staple assembly. As the driver continues to move toward the workpiece, the staple is pushed out of the magazine assembly through the aperture between the base of the magazine channel and the nosepiece and the ends of the legs are forced to penetrate the front surface of the anvil supported workpiece. As the driver continues to push the crown of the staple downward toward contact with the upper surface of the workpiece, the ends of the legs erupt from the lower surface of the workpiece.

Figure 4:
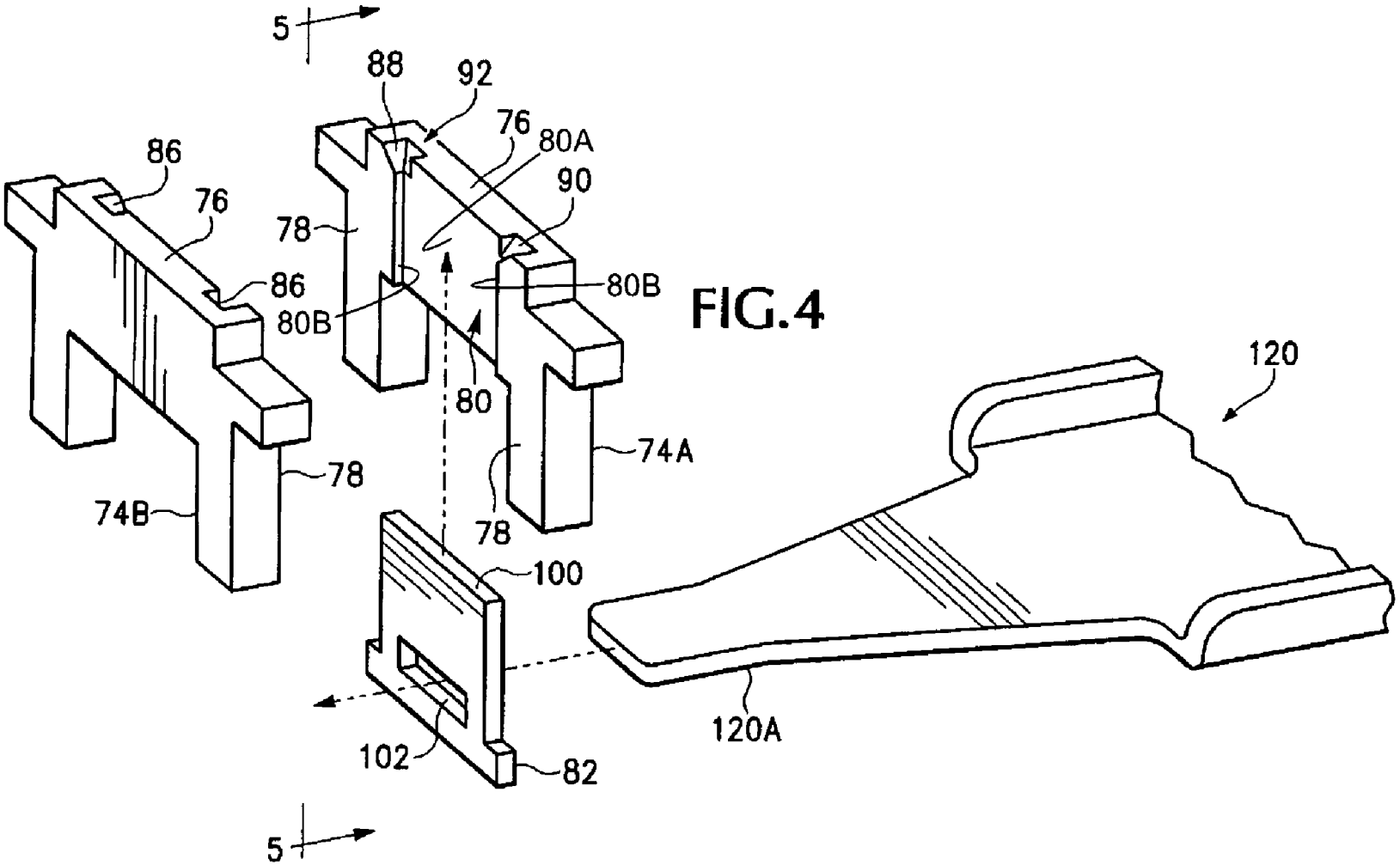
FIG. 4 is an exploded view of the anvil and clincher plate of the electric stapler of FIG. 1

Referring to FIG. 4, the anvil 28 comprises an anvil surface 70 that supports the workpiece during stapling and which includes an aperture to receive the protruding legs of the staple and guide the slidable clincher. The anvil comprises two anvil plates 74A, 74B each including a surface 76 comprising a portion of the anvil surface 70. The anvil plates also include a first surface 78 that is normal to the anvil surface portion 76 of the anvil plate. At least one of the anvil plates includes a centrally located, relieved portion 80 of the first surface 78 that intersects the anvil surface portion and which is defined by a back surface 80A and edge surfaces 80B. In a preferred embodiment, the first surfaces of both anvil plates include identical centrally located relived portions 80. When the anvil is assembled, by securing the anvil plates in the frame, the first surfaces of the two anvil plates are abutted with the anvil surface portions arranged contiguously to form the anvil surface 70. When the first surfaces of the anvil plates are abutted, the relieved portion of the first surface or, in the case of the preferred embodiment, the contiguous relieved portions 80 of the first surfaces 78 form a slot-like aperture 72 extending from the anvil surface through the anvil. The clincher 82 is slidably disposed in the slot and movable from a retracted position in which the upper edge of the clincher is withdrawn below the anvil surface to a clinching position in which the upper edge of the clincher is adjacent to the anvil surface.

Figure 6:
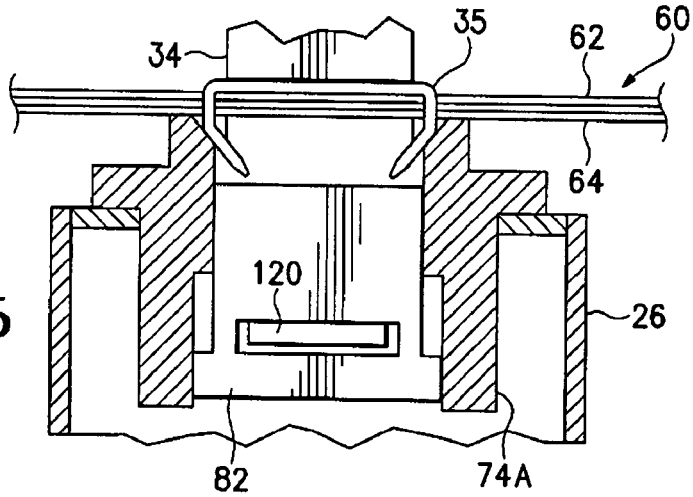
FIG. 6 is a section view along line 5-5 of FIG. 4 illustrating deflection of the legs of the staple by the surfaces of the anvil.

The aperture 72 in the anvil surface includes a recess 84 at the respective ends of the slot portion in which the clincher is housed. The recesses 84, having generally the shape of an inverted oblique pyramid incised in the anvil surface 72, are arranged to receive, respectively, the ends of the legs 38 of a staple 35 when the legs are pushed through the bottom surface of a workpiece 60 The base of the pyramidal recesses, are generally rectangular apertures in the anvil surface and the surfaces 86 of the recesses centermost in the anvil are substantially normal to the anvil surface. The remaining surfaces, an intersecting surface 88 and a ramp surface 90, of the recesses intersect the anvil surface at locations distal of the slot portion and slope downward from the anvil surface toward the centrally located slot in which the clincher is located. Notches 92 incised in the first surface 78 at the intersection of the anvil surface portion 76 form the recesses 84 when the anvil plates are installed in the frame with the first surfaces abutting. Referring to FIGS. 5 and 6, as the legs of the staple are pushed through the workpiece 60 by the driver 34, the ends of the legs descend into the corresponding recesses in the anvil and the ramped sides of the recesses deflect the ends of the legs of the staple toward the center of the staple's crown in preparation for clinching.

The present inventors concluded that many of the problems encountered with clinchers are due the incorporation of several relatively small moving parts in the clincher mechanism. Limiting the clearances between parts that move relative to each other is difficult when several parts, each with its own dimensional variability, are sandwiched together. In addition, as the parts of the clincher mechanism move relative to each other the parts wear, increasing the clearances between the parts and the likelihood that the leg of a staple will lodge between two parts and jam the stapler. Further, the small sizes and irregular shapes of the parts makes wear resistant construction difficult, leading to more rapid wear.

The clincher 82 comprises generally a rectangular plate having an upper edge 100 arranged substantially parallel to the workpiece supporting surface 70 of the anvil and portions defining a slot 102 for receiving an end portion of a clincher drive plate 120. The single plate clincher 82 is substantially larger and more uniform in section than prior art clinchers used to bend the individual legs of a staple and can be hardened to resist impact with the staple and wear due to movement relative to the anvil and the legs of the staple. Likewise, the anvil plates 74A, 74B can be hardened to resist wear. Moreover, the clearance between the clincher and the edges of the aperture 72 in the anvil can be closely controlled because the width of the aperture is determined by the depth of the relieved portion of the first surfaces of the anvil plates which can be machined or otherwise formed to very precise tolerances.

Figure 7:
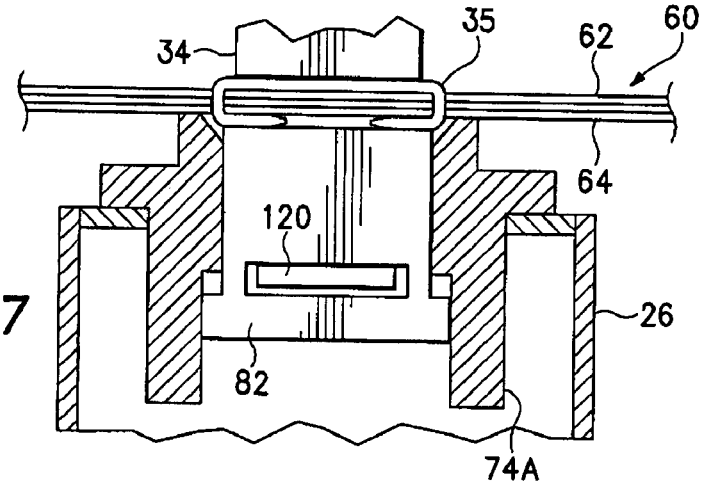
FIG. 7 is a section view along line 5-5 of FIG. 4 showing the clincher in the clinching position.
Figure 8:
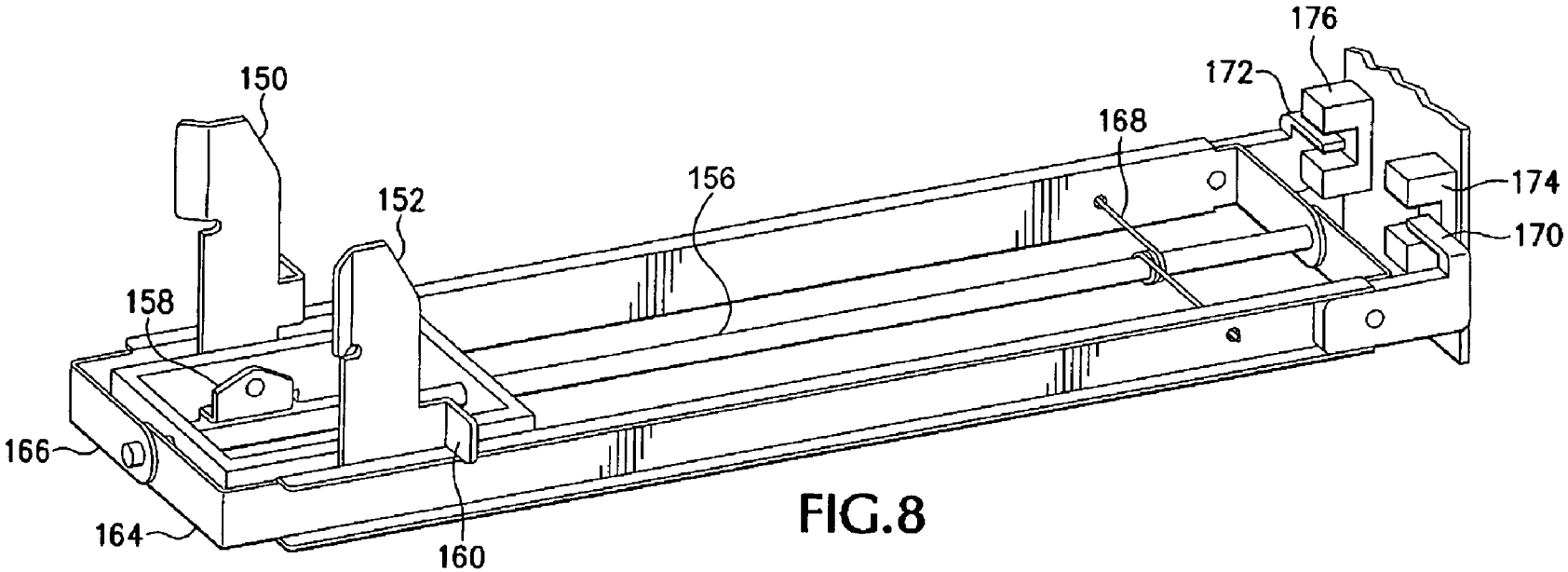
FIG. 8 is a perspective view of the paper guide mechanism.
Figure 9:
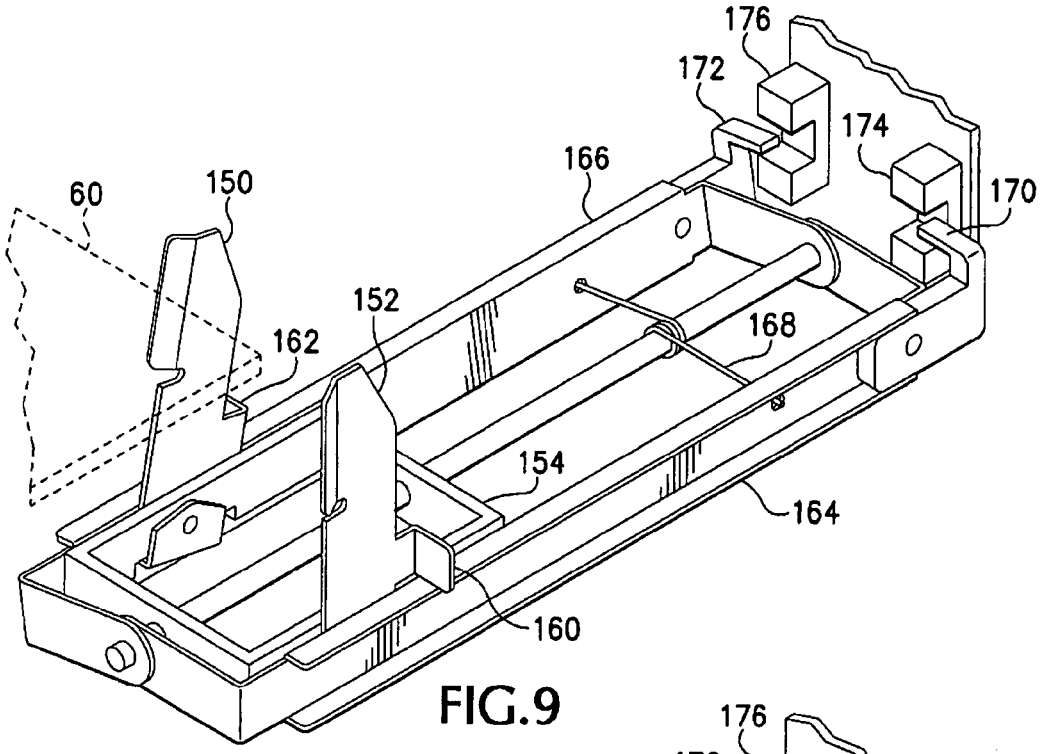
FIG. 9 is a perspective view of the paper guide mechanism illustrating actuation of a paper guide by an out of position workpiece.
Figure 10:
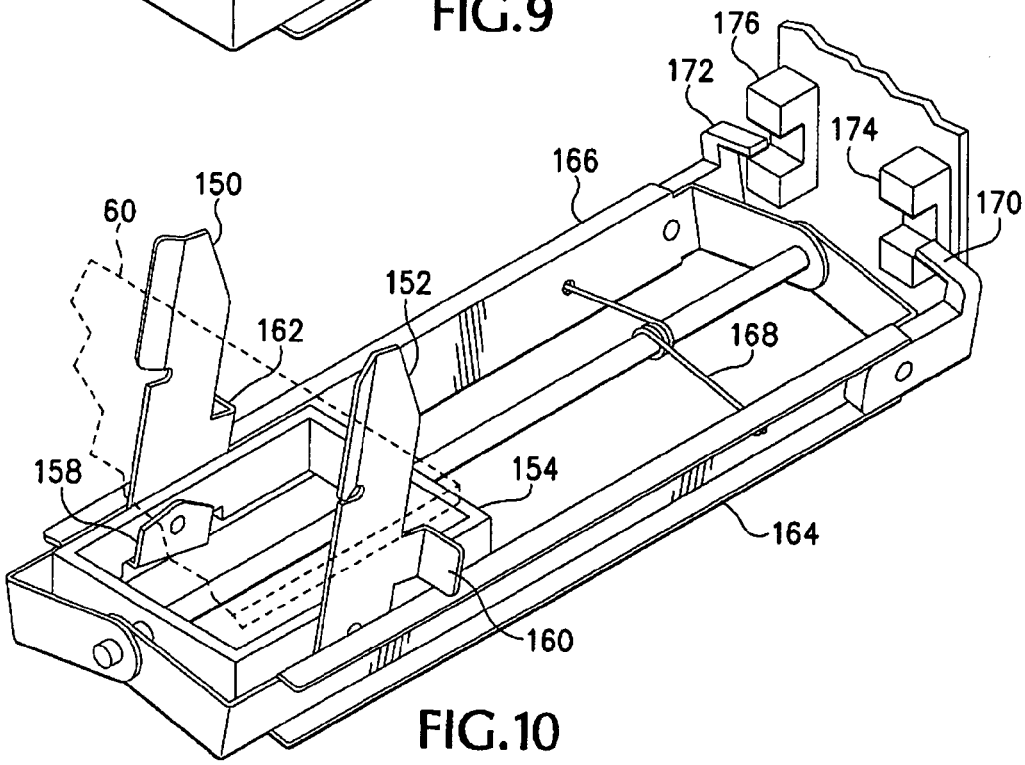
FIG. 10 is a perspective view of the paper guide mechanism illustrating actuation of the paper guides by a properly positioned workpiece.
Figure 11:
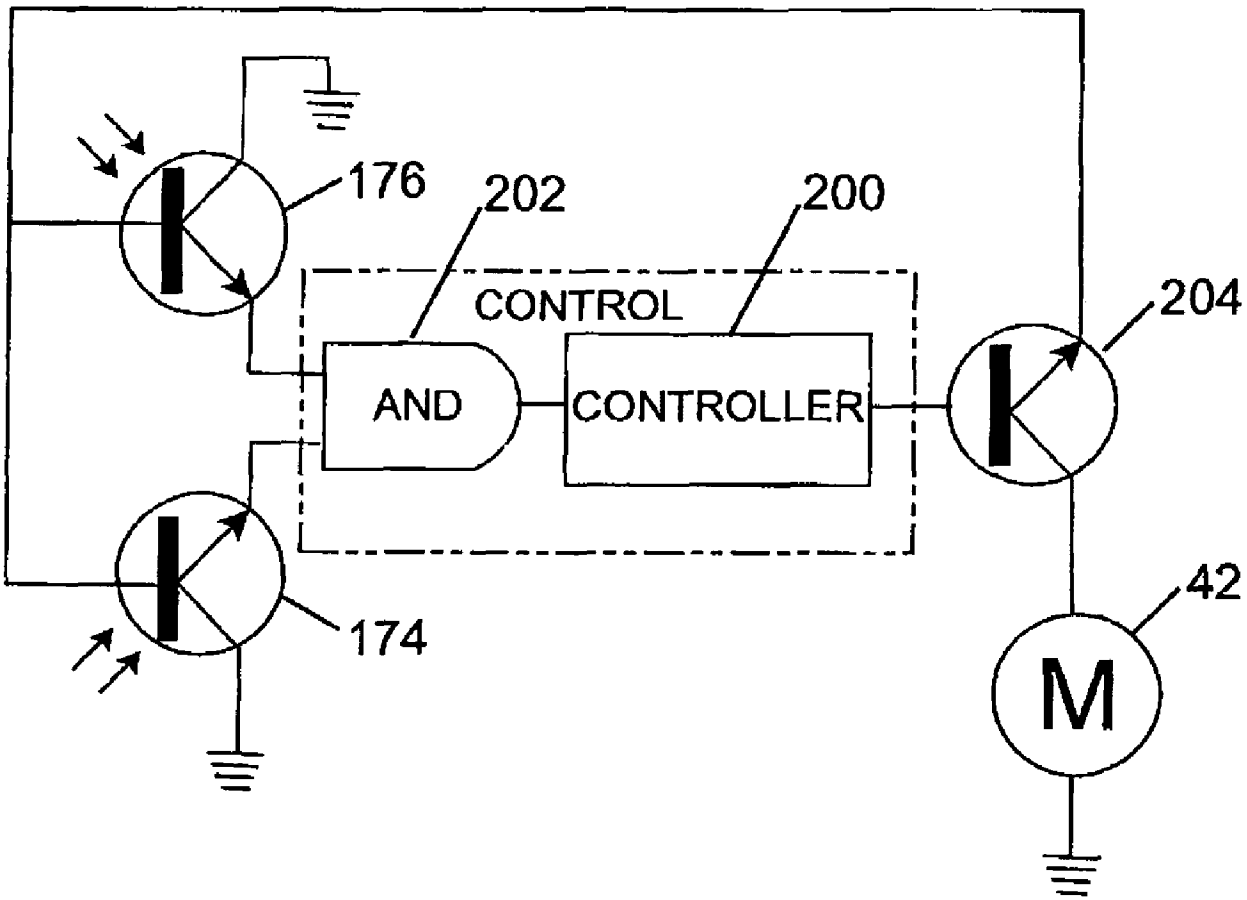
FIG. 11 is a schematic diagram of a motor drive circuit of the stapler of FIG. 1.

When the driver 34 pushes legs of a staple through the workpiece 60, the ends of the legs are, respectively, received in and deflected toward the center of the slot in the anvil by the sloped sides of the recesses. Referring to FIG. 7, the clincher is pushed upward by the clincher drive plate 120 that engages the slot aperture 102 in the clincher. The staple is trapped between the driver bearing downward on the crown and the upper edge of the clincher pushing upward on the ends the legs and the legs are bent back toward the workpiece to clinch the staple.

The clincher drive plate 120 comprises a first portion 120A including a first end portion that engages the slot 102 in the clincher 82. A second portion 120B comprises a pair of parallel arms that extend at an obtuse angle from the second end of the first portion of the clincher drive plate. The clincher drive plate is pivotally mounted on the frame by a pin 122 located proximate the intersections of the first and second portions of the drive plate. The distal ends of the second portion of the clincher drive plate support cam followers 124 that engage respective clincher cam surfaces 126 formed on the inner surfaces of the driven output gears 46. When the output gears are rotated by the motor to drive a staple into a workpiece, the clincher cam surfaces are rotated into contact with the clincher drive plate cam followers causing the clincher drive plate to pivot with respect to the frame and force the clincher upward to clinch the staple.

The present inventors determined that another substantial cause of jamming is improper positioning of the workpiece during stapling. If stapling is attempted when the workpiece is positioned so that only one leg of the staple will pierce the workpiece, the legs of the downward moving staple will experience unequal resistance. The staple can cock and twist on the contact surface of the driver causing the staple to be displaced relative to the driver and lodge between the driver and the nosepiece. The inventors concluded that jamming could be reduced by inhibiting initiation of the stapling cycle unless the workpiece is correctly positioned on the anvil.

Referring to FIGS. 8, 9, 10, and 11, to ensure that the workpiece 60 is properly positioned before the stapling cycle is initiated; the stapler's controller 200 is responsive to signaling of the simultaneous presence of the workpiece at a two paper guides 150, 152, one located to either side of and adjacent to the anvil. The paper guides are pivotally attached to a paper guide bracket 154 that is slidably supported on a paper guide pin 156 by an adjustment bracket 158. The paper guide pin is affixed to the frame of the stapling mechanism. A spring locked adjustment plate permits the paper guide bracket to be selectively locked in alternative positions along the length of the paper guide pin enabling variation of the location of the paper guides relative to the anvil and thereby varying the position of the staple relative to the edge of the workpiece. Each paper guide 150, 152 includes a tab 160, 162 that bears on a respective trigger arm rail 164, 166 that is, in turn, pivotally supported at each end by the paper guide pin and urged into contact with the tab by a trigger rail arm torsion spring 168.

A workpiece 60, inserted between the magazine and the anvil, is pressed against the upwardly projecting portions of the paper guides 150, 152 causing one or both paper guides to pivot with respect to the paper guide bracket. The pivoting of the paper guide 150, 152 causes the tabs 160, 162 to depress the respective trigger arm rail which pivots about its connections to the paper guide pin. Shudder arms 170, 172 attached to the trigger arm rails are displaced by the movement of the respective trigger arm rail actuating respective optical switches 174, 176 to indicate contact between the workpiece and the respective paper guide. The output of an AND gate 202 signals the simultaneous actuation of the two optical switches 174, 176 and the correct positioning of the workpiece for stapling. When the controller 200 senses simultaneous contact between the workpiece and the two paper guides, power is applied to the motor by a driver 204 to initiate the stapling cycle.

The single plate clincher enables precise control of the clearances between the parts of the clincher mechanism and permits hardening of the parts to reduce wear and jamming of the clincher mechanism. Jamming of the stapler is further reduced by inhibiting stapling until the workpiece is correctly positioned so that legs of the staple will be resisted equally as they penetrate the workpiece.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. An anvil for a stapler comprising an anvil plate arranged to be supported by a frame of said stapler and including:

(a) an anvil surface portion;

(b) a side surface arranged substantially normal to said anvil surface portion, said side surface including a relieved portion having a planar back surface substantially centered in said side surface and substantially parallel to a portion of said side surface extraneous to said relieved portion, said back surface offset from said portion of said side surface extraneous to said relieved portion in a direction normal to said portion of said side surface extraneous to said relieved portion and bounded by a first edge surface and a second edge surface, said first edge surface and said second edge surface connecting said back surface to respective portions of said side surface extraneous to said relieved portion, a portion of said back surface intersecting said anvil surface portion;

(c) an intersecting surface intersecting said first edge surface at a distance from a plane coplanar with said anvil surface portion, said intersecting surface sloping to intersect said anvil surface portion at a distance from a plane coplanar with said first edge surface and at a greater distance from a plane coplanar with said second edge surface, said first edge surface substantially normal to said anvil surface portion, and (d) a ramp surface intersecting said intersecting surface and intersecting said back surface at a distance from said plane coplanar with said anvil surface portion, said ramp surface sloping to intersect said anvil surface portion at a distance from a plane coplanar with said back surface.

2. An anvil for a stapler comprising:

(a) an anvil plate arranged to be supported by a frame of said stapler and including:

(i) an anvil surface portion; and (ii) a side surface arranged substantially normal to said anvil surface portion, said side surface including a relieved portion having a planar back surface substantially centered in said side surface and substantially parallel to a portion of said side surface extraneous to said relieved portion, said back surface offset from said portion of said side surface extraneous to said relieved portion in a direction normal to said portion of said side surface extraneous to said relieved portion and bounded by a first edge surface and a second edge surface, said first edge surface and said second edge surface connecting said back surface to respective portions of said side surface extraneous to said relieved portion, a portion of said back surface intersecting said anvil surface portion; and (b) a second anvil plate including a second anvil surface portion and a second anvil plate side surface arranged substantially normal to said second anvil surface portion, said second anvil plate supported by said frame of said stapler with said second anvil plate side surface abutting a portion of said side surface of said anvil plate, said anvil surface portion and said second anvil surface portion arranged contiguously.

3. The anvil of claim 2 wherein said second anvil plate side surface further comprises:

(a) a relieved surface portion including a planar second back surface substantially centered in said second anvil plate side surface and substantially parallel to a portion of said second anvil plate side surface extraneous to said relieved surface portion, said second back surface offset from said portion of said second anvil plate side surface extraneous to said relieved surface portion in a direction normal to said portion of said second anvil plate side surface extraneous to said relieved surface portion; and (b) plural second anvil plate edge surfaces connecting said second back surface to portions of said second anvil plate side surface extraneous of said relieved surface portion.

4. The anvil of claim 3 wherein said second anvil plate further comprises:

(a) a second intersecting surface intersecting one of said second anvil plate edge surfaces at a distance from a plane coplanar with said second anvil surface portion, said second intersecting surface sloping to intersect said second anvil surface portion at a distance from a plane coplanar with said one of said second anvil plate edge surfaces said intersection more distance from a second of said second anvil plate edge surfaces, said second anvil plate edge surfaces substantially normal to said second anvil surface portion; and (b) a second ramp surface intersecting said second intersecting surface and intersecting said second back surface at a distance from said plane coplanar with said second anvil surface portion, said second ramp surface sloping to intersect said second anvil surface portion at a distance from a plane coplanar with said second back surface.

* * * * *